US010727632B2

(12) United States Patent
Szymura

(10) Patent No.: US 10,727,632 B2
(45) Date of Patent: Jul. 28, 2020

(54) MULTI-FUNCTIONAL CONNECTION ASSEMBLY HAVING AN ECCENTRICALLY ARRANGED CONTACT PIN

(71) Applicant: Amphenol-Tuchel Electronics GmbH, Heilbronn (DE)

(72) Inventor: Dawid Szymura, Ilsfeld (DE)

(73) Assignee: Amphenol-Tuchel Electronics Gmbh, Heilbronn (DE)

( * ) Notice: Subject to any disclaimer, the term of this patent is extended or adjusted under 35 U.S.C. 154(b) by 0 days.

(21) Appl. No.: 16/065,289

(22) PCT Filed: Dec. 16, 2016

(86) PCT No.: PCT/EP2016/081495
§ 371 (c)(1),
(2) Date: Jun. 22, 2018

(87) PCT Pub. No.: WO2017/108622
PCT Pub. Date: Jun. 29, 2017

(65) Prior Publication Data

US 2019/0181596 A1 Jun. 13, 2019

(30) Foreign Application Priority Data

Dec. 23, 2015 (DE) ..... 10 2015 122 792

(51) Int. Cl.

| | |
|---|---|
| ***H01R 24/28*** | (2011.01) |
| ***H01R 4/02*** | (2006.01) |
| ***H01R 13/04*** | (2006.01) |
| ***H01R 13/502*** | (2006.01) |
| ***H01R 13/53*** | (2006.01) |
| ***H01R 13/41*** | (2006.01) |
| *H01R 105/00* | (2006.01) |
| *H01R 43/02* | (2006.01) |
| *H01R 43/16* | (2006.01) |

(52) U.S. Cl.
CPC ..... *H01R 24/28* (2013.01); *H01R 4/023* (2013.01); *H01R 13/04* (2013.01); *H01R 13/41* (2013.01); *H01R 13/502* (2013.01); *H01R 13/53* (2013.01); *H01R 43/0207* (2013.01); *H01R 43/16* (2013.01); *H01R 2105/00* (2013.01); *H01R 2201/26* (2013.01)

(58) Field of Classification Search
CPC ..... H01R 13/652; H01R 24/28; H01R 24/30
USPC ..... 439/692, 693, 694, 695, 696, 697
See application file for complete search history.

(56) References Cited

U.S. PATENT DOCUMENTS 2,577,794 A * 12/1951 Minard ..... H01R 4/5008 439/697
3,636,495 A 1/1972 Forsyth, Jr.
(Continued)

FOREIGN PATENT DOCUMENTS

DE 112012001268 T5 1/2014

*Primary Examiner* — Ross N Gushi
(74) *Attorney, Agent, or Firm* — Blank Rome LLP

(57) ABSTRACT

The invention relates to a multi-functional electrical connection assembly for transmitting medium and high current densities, consisting of a socket (2) having contact openings (11), a contact carrier (12), a contact element (1) consisting of a contact plate (9), and a contact pin (4) which protrudes from the contact plate (9) and which is arranged eccentrically on the contact plate (9).

8 Claims, 3 Drawing Sheets

(56) References Cited

U.S. PATENT DOCUMENTS

| | | | | |
|---|---|---|---|---|
| 4,927,376 | A * | 5/1990 | Dickie | H01R 24/28 439/484 |
| 8,460,016 | B2 * | 6/2013 | Liu | H01R 13/6456 439/106 |
| 8,480,410 | B2 * | 7/2013 | Early | H01R 13/665 439/620.21 |
| 8,905,796 | B2 * | 12/2014 | Liu | H01R 13/434 439/744 |
| 2004/0235364 | A1 | 11/2004 | Matsumoto et al. | |
| 2004/0253854 | A1 * | 12/2004 | Lee | H01R 31/06 439/106 |
| 2007/0224842 | A1 * | 9/2007 | Hoepfner | H01R 4/02 439/34 |
| 2013/0196548 | A1 | 8/2013 | Mo et al. | |

* cited by examiner

MULTI-FUNCTIONAL CONNECTION ASSEMBLY HAVING AN ECCENTRICALLY ARRANGED CONTACT PIN

RELATED APPLICATIONS

This application is a national stage application of International Application No. PCT/EP2016/081495, filed Dec. 16, 2016, which claims priority to German Patent Application No. 10 2015 122 792.4, filed Dec. 23, 2015, the entire disclosures of which are hereby incorporated by reference.

The invention relates to a contact element comprising a contact plate and a contact pin which is integrated in a multi-functional electrical connection assembly.

The prior art discloses different electrical connection assemblies for transmitting high current densities. Numerous applications can be found in the automobile sector in particular. An increased requirement has arisen in recent years on account of the further development of and advances in electromobility. A significant advantage in standardized electrical connection assemblies is the option of cost-optimized operation of production lines being possible. A significant disadvantage in conventional electrical connection assemblies is that the existing installation space in the housing is often insufficient for the connection of relatively large cable cross sections and therefore a completely new arrangement of the contacts has to be implemented in the housing, this typically requiring a larger installation space.

The object of the invention is therefore to overcome the abovementioned disadvantages and to improve firstly a contact element and secondly an electrical connection assembly to the effect that an existing plug socket can also be used for the purpose of connecting different, in particular relatively large, cable cross sections. This is increasingly important particularly in the case of certain applications, such as vehicle applications for example, since the size of the plug socket cannot be changed for installation space reasons.

This object is achieved by the combination of features as claimed in patent claim 1.

Therefore, the invention provides a multi-functional electrical connection assembly for transmitting medium and high current levels, comprising a plug socket with contact openings, a contact carrier, and a plurality of contact elements preferably designed with a compacted portion. The contact element according to the invention comprises a contact plate and a contact pin which protrudes from the contact plate and is arranged eccentrically on the contact plate.

Said arrangement of the contact pins on the contact plate allows variable configuration of the multi-functional electrical connection assembly. As a result, relatively large cable cross sections can nevertheless be connected to the contact plates for the purpose of transmitting relatively high current densities, without the plug socket receiving the contacts having to be changed, even in the case of dense apposition of the contacts. This is a significant advantage over the prior art, particularly owing to the limited and predetermined installation space.

In one particularly advantageous refinement of the invention, the contact pin of the contact element is arranged orthogonally in relation to the contact plate. The multi-functional electrical connection assembly substantially comprises the plug socket, the contact elements and the contact carrier, wherein the connection region of the cable is preferably formed by means of compacting, so that direct connection of the cable to the contact plate (without a connecting element) is possible. Contact elements which are arranged orthogonally with respect to the contact plate and to the openings of the plug socket additionally facilitate insertion into the opening of the plug socket.

In a further embodiment, it is provided that the contact carrier has recesses (cavities) for receiving the contact elements. The contact elements are held on the contact pins within the plug socket and, on the opposite side, with the contact plate in said respective recess of the contact carrier. In addition, the individual current-carrying contact elements are at a distance from one another and electrically insulated from one another. In particular, the contact elements are held in the contact carrier and will be inserted into the plug socket as a preassembled unit.

In one refinement of the invention, the compacted portion is arranged directly on the contact plate of the contact element. Electrical losses owing to the contact resistance are to be kept as low as possible in the multi-functional electrical connection assembly. This is achieved by the selection of suitable contact-making means at the transitions of the individual components of the multi-functional electrical connection assembly. For this reason, the compacted portion is advantageously arranged with a non-releasable connection on the contact plate of the contact element.

Furthermore, an embodiment in which the connection between the contact pins and the contact plate is a preferably welded connection is advantageous. A hard-soldering process is often used for producing non-releasable connections in contact elements which are already in use. In contrast to welding, rather than the component itself, a solder is locally melted by the action of temperature and connects the contact pin and the contact plate here. A connection of relatively high strength is ensured by the use of the welding technique. The contact pin and the contact plate are locally melted at a connection point during welding and, after solidification, form a non-releasable connection of very high strength. This results not only in a high mechanical strength, but also in an electrically highly conductive transition region between the contact plate and the respective contact pin of the contact element.

In one preferred embodiment of the invention, the contact pins of the contact element are designed in an interlocking manner in relation to the contact openings of the plug socket, and a starting section of the contact element is latched into the contact opening of the plug socket, as a result of which said contact element is prevented from falling out. At the same time, assembly and disassembly of the multi-functional electrical connection assembly is possible without a special tool.

In a further advantageous refinement of the invention, it is provided that the contact pin has a starting section, a middle section and an end section, and a diameter $d_1$ of the middle section is smaller than a diameter $d_2$ of the end section. The contact pins of the contact elements are preferably provided with different diameters for the various sections, so that simplified assembly of the multi-functional electrical connection assembly is made possible.

In one particularly preferred refinement of the invention, a step is formed between the middle section and the end section on account of the different diameters $d_1$ and $d_2$.

As an advantageous embodiment, it is provided that the line connection regions with the contact plate are held at least partially eccentrically with respect to the center of the contact plate, and the contact elements are arranged on the contact plate at least partially outside the center.

In addition to an eccentric arrangement of the contact pins on the contact plate, an additional eccentric arrangement of the compacted portion with the line held therein is advantageous in order to be able to use lines with a relatively large cross section given the existing installation space. Relatively high current densities can be transmitted as a result.

In a further development of the electrical connection assembly, it is provided that the compacted portion forms an intentionally non-releasable connection in relation to the contact plate. In order to prevent undesired contact resistances, a non-releasable connection is provided between the contact plate and the compacted portion.

Other advantageous developments of the invention are identified in the dependent claims and will be illustrated in greater detail below together with the description of the preferred embodiment of the invention with reference to the figures, in which:

Figure 1:
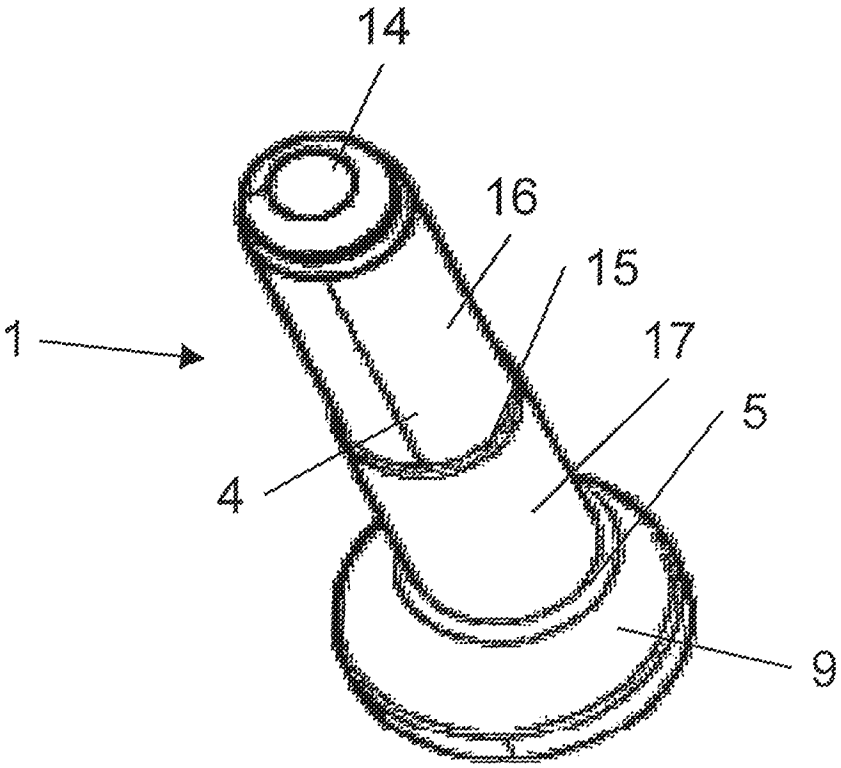
FIG. 1 shows a perspective illustration of a contact element according to the invention.

FIG. 1 shows a perspective illustration of a variant embodiment of a contact element 1. Here, the contact pin 4 of the contact element 1 is held eccentrically with respect to a center of the contact plate 9 on the contact plate 9 by means of a connection 5. The contact pin 4 is designed with an end-side starting section 14, a middle section 16 with a diameter $d_1$ and an end section 17 with a diameter $d_2$, wherein the diameter $d_1$ is smaller than the diameter $d_2$. This creates a step 15 between the middle section 16 and the end section 17, which step serve as a stop for the in the contact openings 11 as shown in FIG. 3 and define the distance between the plug socket 2 shown in FIG. 2 and the contact carrier 12. The connection 5 is an intentionally non-releasable connection which is preferably implemented as a welded connection.

One advantage over methods such as hard soldering which are also used for example is the local melting of the contact areas of the contact pin 4 and a region of the contact plate 9, so that a mechanically very stable connection together with a low contact resistance is produced.

Figure 2:
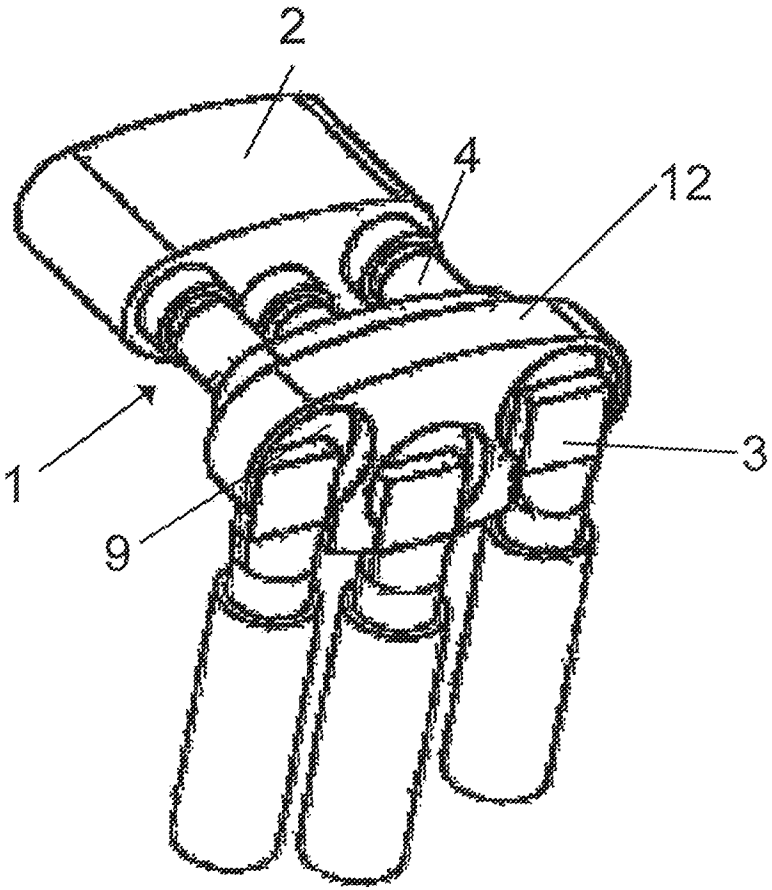
FIG. 2 shows a perspective overall illustration of the multi-functional electrical connection assembly.
Figure 3:
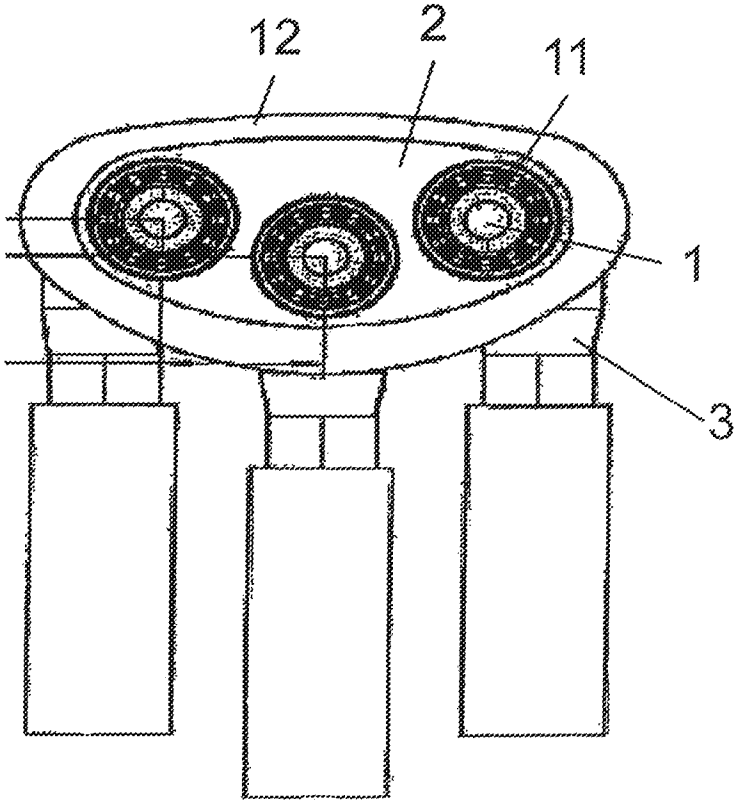
FIG. 3 shows a front view of the multi-functional electrical connection assembly.

FIG. 2 shows a perspective illustration of an embodiment according to the invention of a multi-functional electrical connection assembly for transmitting medium and high current levels, comprising a plug socket 2, a contact carrier 12 and three electrically conductive contact elements 1 which are designed as a contact pin 4 in one direction and as a contact plate 9 on the opposite side. Here, the contact pins 4 of the contact elements 1 are held in an interlocking manner in the contact openings 11, shown in FIG. 3, of the plug socket 2, and the contact plates 9 are held on the contact carrier 12. An electrical line forms a compacted portion 3 by way of which said line is fastened to the contact plate 9. The contact pins 4 of the contact elements 1 are arranged eccentrically with respect to a center point of the contact plate 9.

FIG. 3 shows a front view of the multi-functional electrical connection assembly. It is clear from figure that, of the three compacted portions 3, only the middle compacted portion 3 is arranged centrally with respect to the position of the contact element 1. The two outer compacted portions are each shifted horizontally outward in the direction of an outer edge of the contact carrier 12. Together with an eccentric arrangement of the contact pins 4, shown in FIG. 2, on the contact plate 9, it is possible to use lines with a relatively large cross section with the plug socket 2, in order to transmit higher current levels.

The invention is not restricted in terms of implementation to the preferred exemplary embodiments specified above. Rather, a number of variants which make use of the solution presented, even in the case of embodiments of fundamentally different kinds, are conceivable. For example, electrically conductive elements of the electrical connection assembly are preferably composed of copper, wherein other materials are also conceivable.

The invention claimed is:

1. An electrical connection assembly, comprising:

a plug socket with contact openings, a contact carrier, a contact element comprising a contact plate and a contact pin which protrudes from the contact plate and is arranged eccentrically on the contact plate, the contact pin being held in one of the contact openings of the plug socket, and a connection between the contact pin and the contact plate is an ultrasonically welded connection.

2. The electrical connection assembly as claimed in claim 1, wherein the contact pin of the contact element is arranged orthogonally in relation to the contact plate.

3. The electrical connection assembly as claimed in claim 1, wherein the contact carrier holds the contact plate.

4. The electrical connection assembly as claimed in claim 1, wherein an electrical line is connected to the contact plate.

5. The electrical connection assembly as claimed in claim 1, wherein the contact pin has an end-side starting section, a middle section and an end section, and a diameter of the middle section is smaller than a diameter of the end section.

6. The electrical connection assembly as claimed in claim 5, wherein a step is formed between the middle section and the end section that defines a maximum insertion depth of the contact element into one of the contact openings.

7. The electrical connection assembly as claimed in claim 1, wherein an electrical line connection regions designed as a compacted portion and is held at least partially eccentrically with respect to an axis through a center of the contact plate.

8. An electrical connection assembly, comprising:

a plug socket with contact openings, a contact carrier, a contact element comprising a contact plate and a contact pin which protrudes from the contact plate and is arranged eccentrically on the contact plate, and the contact pin has an end-side starting section, a middle section and an end section, a diameter of the middle section is smaller than a diameter of the end section, and a step being formed between the middle section and the end section that defines a maximum insertion depth of the contact element into one of the contact openings.

* * * * *